US005834700A

United States Patent [19]

Panella

[11] Patent Number: 5,834,700

[45] Date of Patent: Nov. 10, 1998

[54] ELECTRICAL CIRCUIT ARRANGEMENT

[75] Inventor: Augusto P. Panella, Bolingbrook, Ill.

[73] Assignee: Molex Incorporated, Lisle, Ill.

[21] Appl. No.: 778,461

[22] Filed: Jan. 3, 1997

[51] Int. Cl.[6] ..... H01B 7/08

[52] U.S. Cl. ..... 174/115; 174/117 F

[58] Field of Search ..... 174/115, 117 R, 174/117 F, 117 FF

[56] References Cited

U.S. PATENT DOCUMENTS

| | | | |
|---|---|---|---|
| 3,763,306 | 10/1973 | Marshall | 174/115 |
| 4,313,029 | 1/1982 | Bunish | 174/115 |
| 4,460,804 | 7/1984 | Svejkovsky | 174/117 A |
| 5,091,610 | 2/1992 | Strauss | 174/117 F |
| 5,235,132 | 8/1993 | Ainsworth et al. | 174/117 F X |
| 5,428,187 | 6/1995 | Crane et al. | 174/115 X |
| 5,428,189 | 6/1995 | Dorner et al. | 174/117 F |

*Primary Examiner*—Bot L. Ledynh
*Assistant Examiner*—Marc D. Machtinger
*Attorney, Agent, or Firm*—Stephen Z. Weiss

[57] ABSTRACT

An electrical circuit arrangement includes at least three adjacent spaced-apart, elongate parallel conductors. Specifically, a middle conductor has two oppositely facing first and second surfaces. A left conductor has a surface facing the first surface of the middle conductor to define a first electrical coupling. A right conductor has a surface facing the second surface of the middle conductor to define a second electrical coupling. The shape of the facing surfaces between the left conductor and the middle conductor is different from the shape of the facing surfaces between the right conductor and the middle conductor. Therefore, the electrical characteristics of the first electrical coupling is different from the electrical characteristics of the second electrical coupling.

14 Claims, 5 Drawing Sheets

ELECTRICAL CIRCUIT ARRANGEMENT

FIELD OF THE INVENTION

This invention generally relates to the art of electrical conductors or terminals and, particularly, to an electrical circuit arrangement for controlling the electrical characteristics between adjacent conductors.

BACKGROUND OF THE INVENTION

In electrical circuit arrangements, including adjacent conductors or terminals in high speed digital systems, there is a continuing problem of "crosstalk" (horizontal capacitance) between adjacent conductors. Such crosstalk occurs in many electrical devices such as modular jack connectors, input-output connectors, other connectors of various types, electrical cables and arrays of terminal pins.

In the past, various schemes, constructions or methods have been used to uniformly reduce the crosstalk between conductors in any given electrical circuit arrangement. The invention herein is designed to selectively control crosstalk between various conductors or terminals in a given electrical circuit arrangement, rather than simply trying to wholesale eliminate the crosstalk.

SUMMARY OF THE INVENTION

An object, therefore, of the invention is to provide an electrical circuit arrangement wherein the electrical characteristics, such as the crosstalk (horizontal capacitance) between selected conductors in the circuit arrangement, is different.

In one embodiment of the invention, an electrical circuit arrangement includes at least three adjacent spaced-apart, elongate parallel conductors including a middle conductor having two oppositely facing surfaces. A left conductor has a surface facing the first surface of the middle conductor to define a first electrical coupling. A right conductor has a surface facing the second surface of the middle conductor to define a second electrical coupling.

The invention contemplates that the shape of the facing surfaces between the left conductor and the middle conductor be different from the shape of the facing surfaces between the right conductor and the middle conductor. Therefore, the electrical characteristics of the first electrical coupling is different from the electrical characteristics of the second electrical coupling.

As disclosed herein, the facing surfaces between one of the left or right conductors and the middle conductor are narrower than the facing surfaces between the other of the left or right conductors and the middle conductor. The narrower facing surfaces cause less crosstalk (horizontal capacitance) than the wider surfaces. In one embodiment of the invention, the facing surfaces between at least one of the left or right conductors and the middle conductor are pointed. In another embodiment, the facing surfaces between at least one of the left or right conductors and the middle conductor are generally flat. In still a further embodiment, the facing surfaces between at least one of the left or right conductors and the middle conductor are rounded.

The concepts of the invention comprising the unique electrical circuit arrangement are shown herein in one embodiment wherein the conductors are in a generally parallel array in an electrical cable. In another embodiment, the conductors comprise terminals in an electrical connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
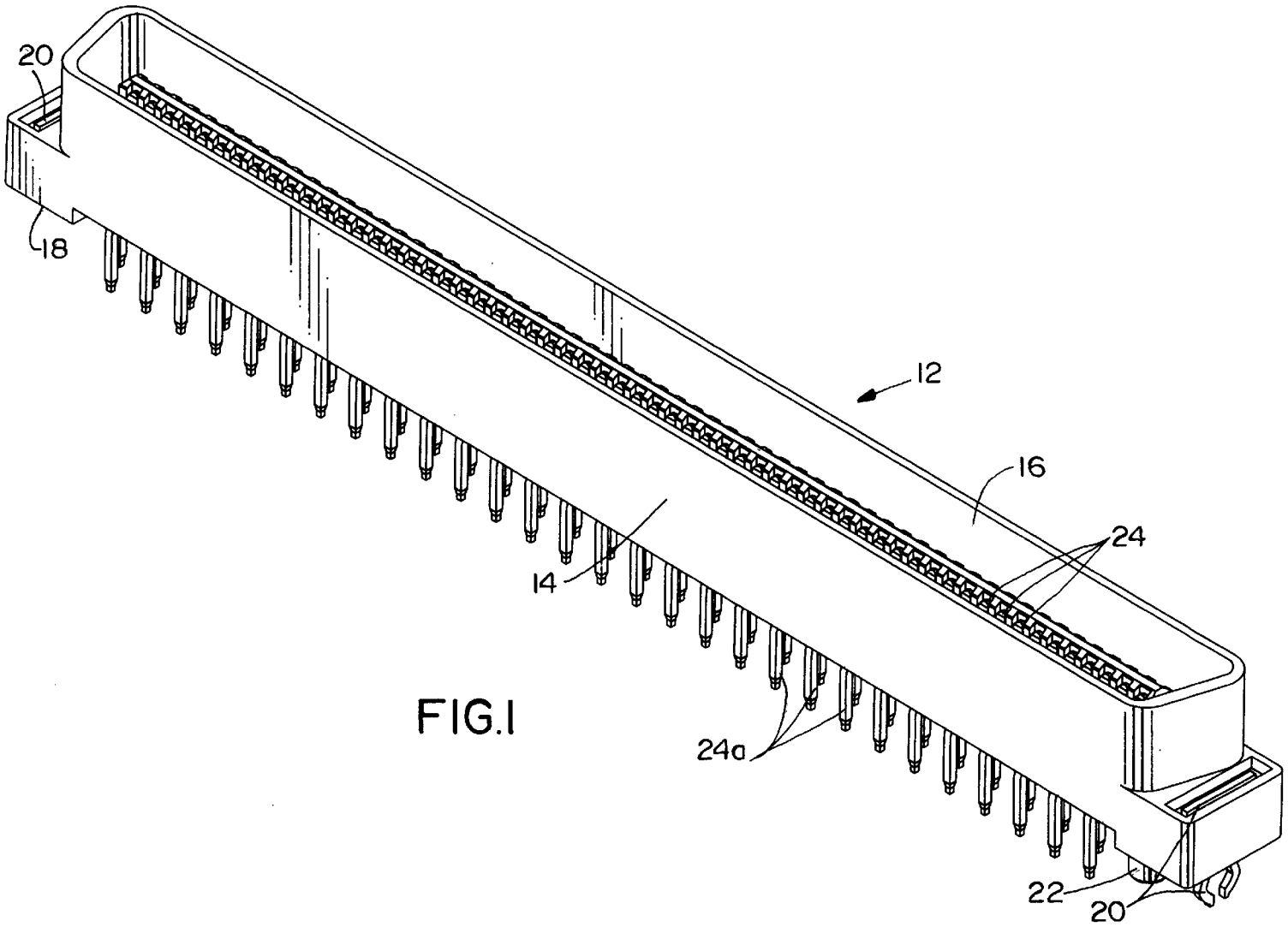
FIG. 1 is a perspective view of an electrical connector wherein an electrical circuit arrangement according to the invention has applicability.
Figure 2:
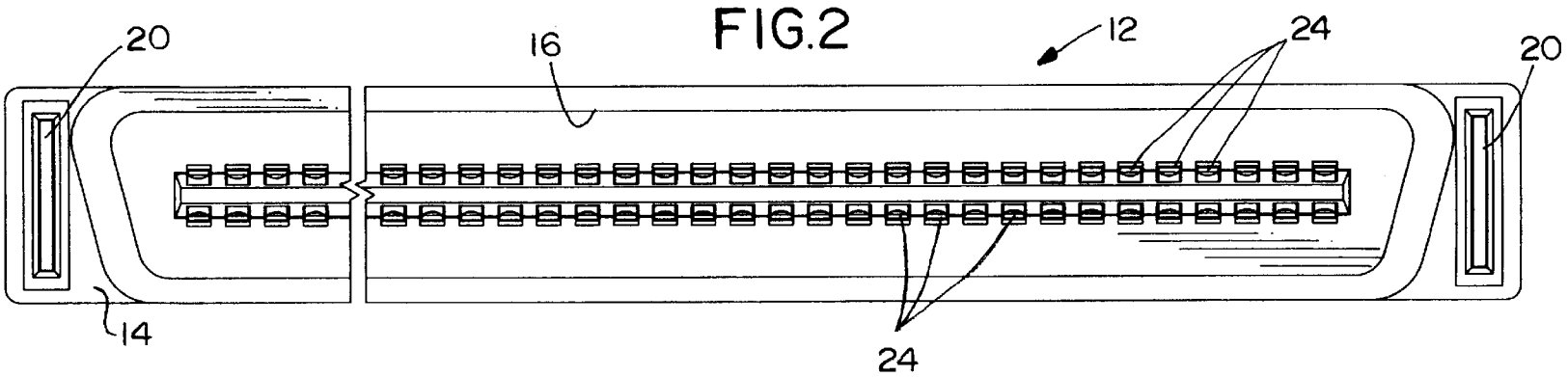
FIG. 2 is a fragmented front elevational view of the connector of FIG. 1.
Figure 3:
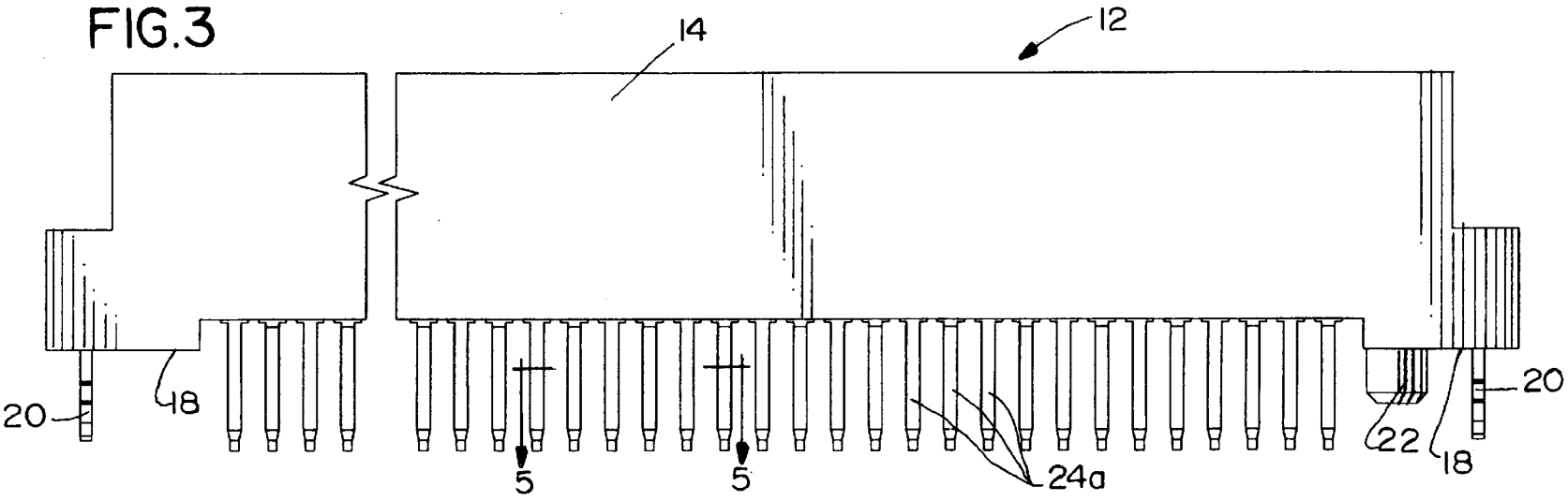
FIG. 3 is a fragmented top plan view of the connector of FIG. 2.

Referring to the drawings in greater detail, FIGS. 1–3 show an electrical connector in which an electrical circuit arrangement according to the invention has applicability. In particular, an electrical connector 12 includes an elongated dielectric housing 14, such as of molded plastic material or the like. The housing has a receptacle 16 defining a mating face of the connector for mating with a complementary connector, such as a plug connector inserted into receptacle 16. The opposite face 18 of the housing is adapted for surface mounting on a printed circuit board. FIG. 3 shows that a pair of boardlocks 20 may depend from housing 14 for insertion into appropriate mounting holes in the printed circuit board. A polarizing peg 22 also may depend from housing 14 for inserting into a polarizing hole in the circuit board. The housing mounts a plurality of terminals 24 which, as best seen in FIG. 2, are arranged in two rows lengthwise of the housing. The terminals have tails portions 24*a*, also in two rows and depending from surface 18 of the housing for insertion into appropriate holes in the printed circuit board. The tails typically are soldered to circuit traces on the board and/or in the holes. To this extent, connector 12 is generally conventional.

Figure 4:
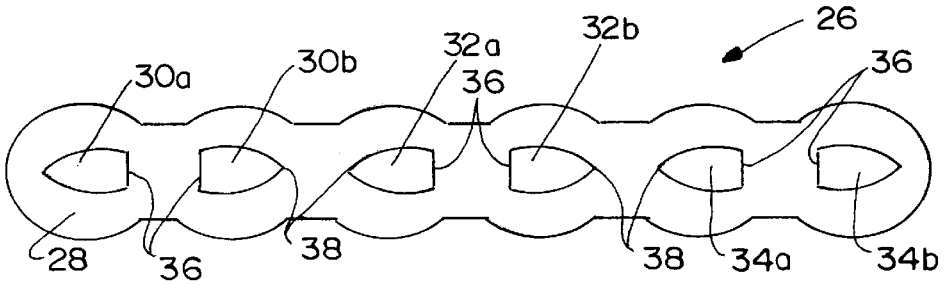
FIG. 4 is a section through a flat electrical cable embodying an electrical circuit arrangement incorporating the concepts of the invention.

FIG. 4 shows a generally flat electrical cable, generally designated 26, which includes a dielectric 28 surrounding three pairs of conductors 30*a*,30*b*; 32*a*,32*b* and 34*a*,34*b*.

Therefore, conductors 30*a* and 30*b* comprise a left-hand pair, conductors 32*a* and 32*b* comprise a center pair and conductors 34*a* and 34*b* comprise a right-hand pair. It can be seen that the facing surfaces 36 between the conductors in each pair are generally flat. However, the facing surfaces 38 between the conductors of two adjacent pairs are pointed. Of course, this results in the facing flat surfaces 36 forming a greater interface area than the opposing pointed surfaces 38.

Figure 5:
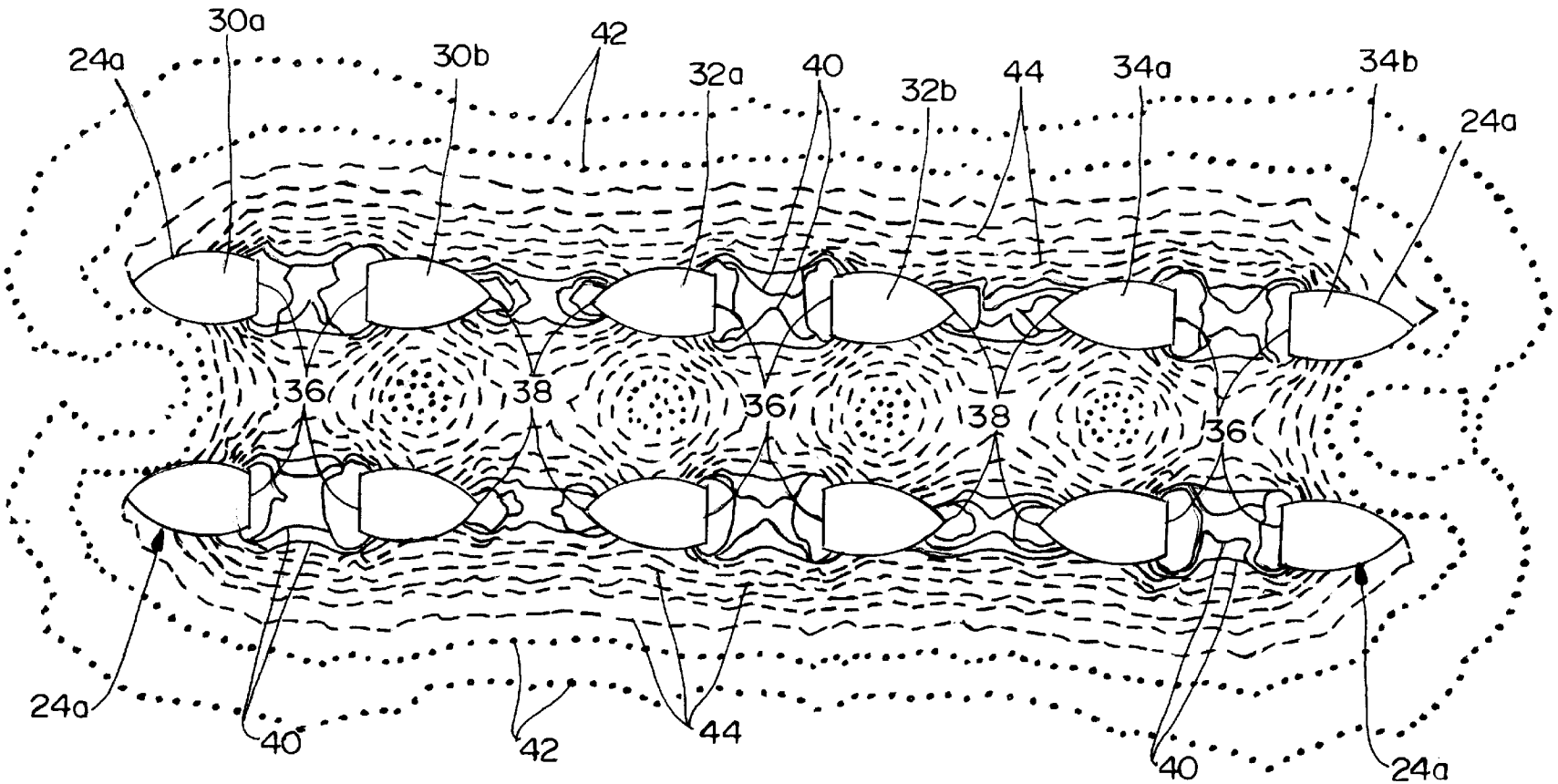
FIG. 5 is a computer generated diagram of the electrical field between the terminals in the connector of FIGS. 1–3, as through the tails of the connector generally along line 5—5 of FIG. 3.

Referring to FIG. 5, this diagram shows a section through three pairs of the terminal tails 24*a* in each of the two rows of terminals in connector 12 as might be taken along line 5—5 of FIG. 3. For clarity of description and understanding as well as cohesion between FIGS. 4–6, the terminal tails 24*a* in FIG. 5 have been numbered corresponding to the conductors in FIG. 4 so that the depiction in FIG. 5 includes two rows of conductors (terminal tails) with three pairs of conductors (terminal tails) in each row. Therefore, as with the conductors in FIG. 4, the conductors or terminal tails in each of the top and bottom rows in FIG. 5 include a left-hand pair 30*a*,30*b*; a center pair 32*a*,32*b* and a right-hand pair 34*a*,34*b*. Again, the facing surfaces 36 between the conductors in each pair are relatively large and flat, whereas the facing surfaces 38 between the conductors of adjacent pairs are relatively narrow and pointed.

It should be understood that when dealing with electrical "pairs" of conductors as described above in relation to FIGS. 3–6, the electrical lines in each pair of conductors are electrically driven together. The electrical coupling between the conductors in each commonly driven pair is quite high. In addition, crosstalk between the conductors of any commonly driven pair can be beneficial.

Figure 6:
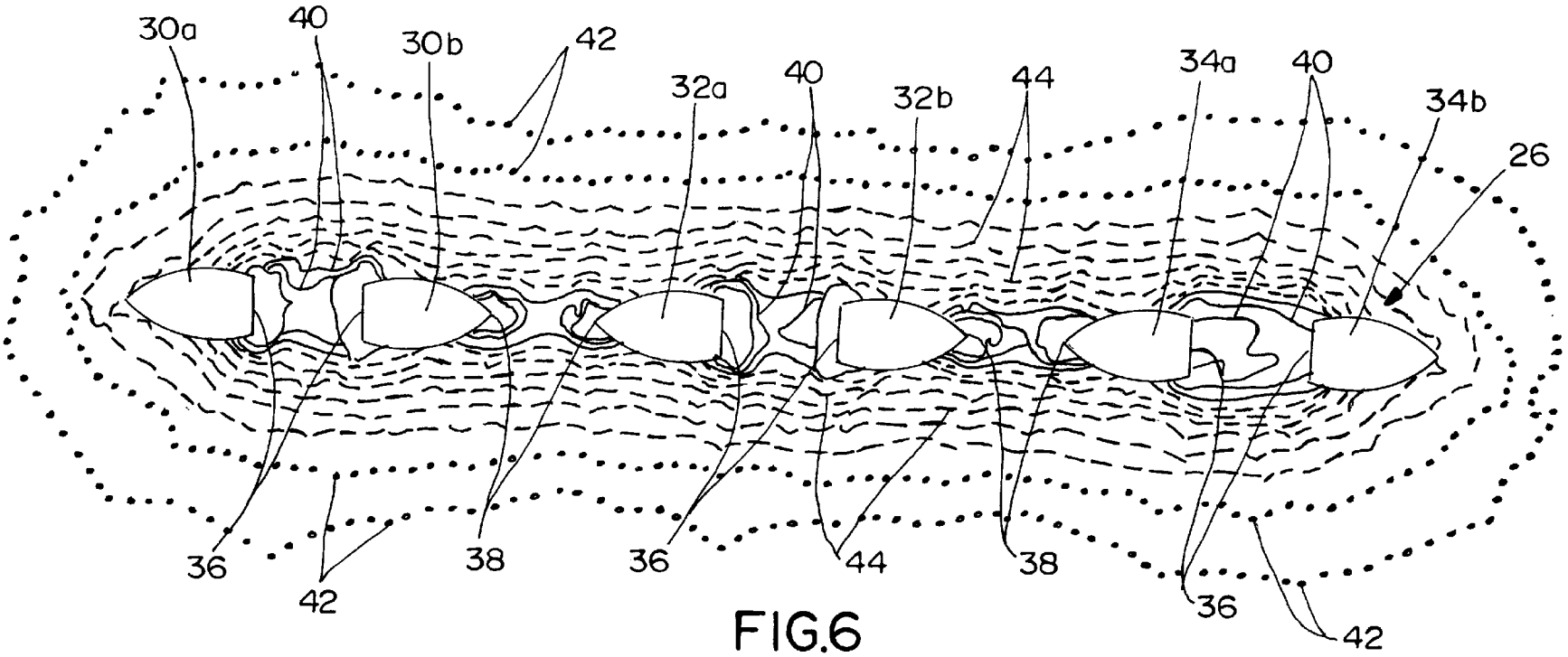
FIG. 6 is a computer generated diagram of the electrical field between the conductors in the cable of FIG. 4.

FIGS. 5 and 6 represent computer generated diagrams of the electrical fields between the conductors in connector 12 (FIGS. 1–3) and cable 26 (FIG. 4), respectively. In other words, FIG. 5 corresponds to the terminal tails 24*a* of connector 12, and FIG. 6 corresponds to the conductors of cable 26 in FIG. 4.

Before going into detail of the computer generated diagrams of FIGS. 5 and 6, it should be understood that, very generally, capacitance is proportional to the amount of energy stored in the electrical field in and around a particular structure (e.g. conductor). In a circuit, capacitance is proportional to the amount of energy stored in the electric field due to the voltage differential across a dielectric whether it be plastic or air. In the following equation:

$$U_e = \tfrac{1}{2} C v^2$$

$U_e$ is the energy stored in the electric field, C is the capacitance, and v is the voltage across the dielectric. The computer generated diagrams of FIGS. 5 and 6 were made by using the Maxwell 2D Parameter Extractor software version 1.7.06 published by Ansoft Corporation. The software computes the capacitance between two lines or conductors by first simulating the electric field that arises when a voltage differential is applied and then computing the energy stored in the simulated field. It then solves for capacitance in terms of the computed field energy ($U_e$) in the following equation:

$$C = \frac{2U_e}{v^2}$$

This software was used to generate the electric field diagrams of FIGS. 5 and 6.

In FIGS. 5 and 6, solid field lines 40 represent the highest electrical field magnitude (volts). Dotted field lines 42 represent the lowest electric field magnitude. Dashed field lines 44 represent the electric field of intermediate magnitude. Of course, it should be understood that whereas capacitance is proportional to the amount of energy stored in the electric field in and around the conductors, the capacitance is proportional to or represents the "coupling" between the conductors. The capacitance also is related to the crosstalk between the conductors.

With the above understanding, it can be seen in FIGS. 5 and 6 that field lines 40 of highest electric field magnitude are quite scattered or broad in the area between larger flat facing surfaces 36 of the conductors in each pair 30*a*,30*b*; 32*a*,32*b* and 34*a*,34*b* thereof. This would represent a high coupling between the conductors of any given pair, as well as high crosstalk but, it should be understood, that crosstalk between cooperating pairs of conductors may not be a problem.

On the other hand, it can be seen in FIGS. 5 and 6 that the field lines 40 of highest electric field magnitude in the area between facing pointed surfaces 38 are considerably closer together or in a tight pattern representing a lesser capacitance field and, correspondingly, lesser crosstalk. This is of considerable advantage, because it is not desired to have significant crosstalk between the conductors of adjacent pairs.

By varying the area of the facing surfaces between adjacent conductors, the capacitance field and, therefore, the crosstalk between the adjacent conductors can be varied or controlled. The examples of FIGS. 1–6 wherein it is desirable to minimize the magnitude of the electric field (i.e. capacitance coupling or crosstalk) between the conductors of adjacent pairs thereof, while allowing significantly higher electric field magnitudes (i.e. capacitance coupling or crosstalk) between the conductors of any given pair, is but one application of the invention involving controlling the electrical characteristics or the electrical coupling between adjacent conductors.

Figure 7:
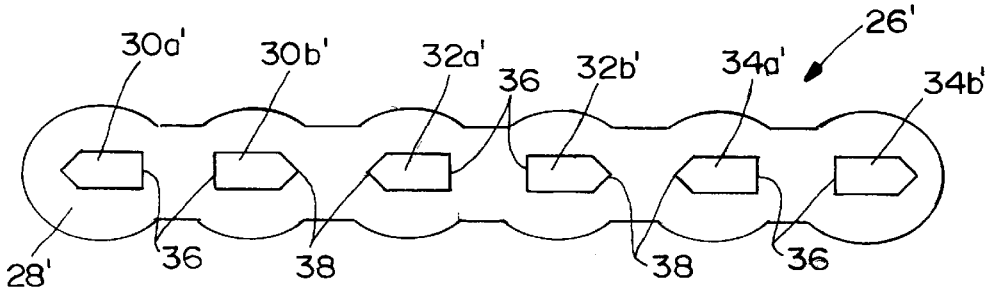
FIG. 7 is a section through another flat cable having conductors with somewhat different configurations than the conductor in FIG. 4.

FIG. 7 shows another generally flat electrical cable, generally designated 26', which includes a dielectric 28' surrounding three pairs of conductors 30*a'*,30*b'*; 32*a'*,32*b'* and 34*a'*,34*b'*. Cable 26' is similar to cable 26 (FIG. 4) except that opposing flat surfaces 36 between the conductors of each pair and opposing pointed surfaces 38 between the conductors of adjacent pairs are formed on generally flat or planar conductors versus the curved conductors shown in FIG. 4.

Figure 10:
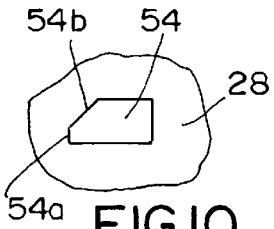
FIG. 10 is a view similar to that of FIGS. 8 and 9, with the conductor having yet a further different edge configuration.
Figure 8:
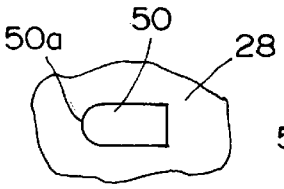
FIG. 8 is a fragmented section through a single conductor having a different edge configuration.
Figure 9:
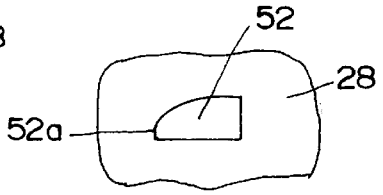
FIG. 9 is a view similar to that of FIG. 8, with the conductor having still another different edge configuration.

FIGS. 8–10 simply show further examples of reducing the area of the facing surfaces of conductors versus the pointed surfaces 38 in the embodiments described hereinbefore. In all of FIGS. 8–10, the conductors are embedded in a dielectric 28.

Specifically, in FIG. 8, conductor 50 has a rounded edge 50*a* to reduce the surface area which would face an adjacent conductor. In FIG. 9, conductor 52 has a quarter-round surface 52*a* which still reduces the edge surface area. In FIG. 10, conductor 54 has a flat surface 54*a*, but the flat surface is considerably narrower than the flat surfaces 36 described above, because the remainder of the edge 54*b* of the conductor is tapered or angled back toward the adjacent side of the conductor. In all of the embodiments of FIGS. 7–10, by opposing the conductors with another conductor of a similarly reduced surface area, the capacitance coupling between the adjacent couplings is minimized which, in appropriate applications, is effective to also minimize the crosstalk between the adjacent conductors.

Figure 11:
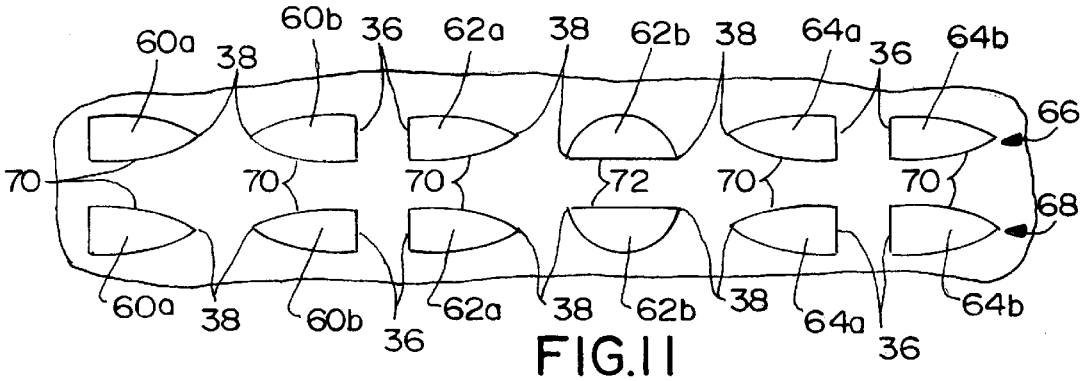
FIG. 11 is an illustration of the invention incorporated in the conductors between two rows of conductors.

Lastly, FIG. 11 is an illustration which shows an electrical circuit arrangement, generally designated 58, in which not only can the crosstalk between adjacent conductors in any given row of conductors (i.e. FIGS. 5 and 6) be controlled, but the crosstalk or capacitive coupling between the conductors in adjacent rows also can be controlled. In particular, FIG. 11 shows three pairs of conductors 60*a*,60*b*; 62*a*,62*b* and 64*a*,64*b* in each of two rows, generally designated 66 and 68. As with the descriptions of the arrays of conductors in FIGS. 5 and 6, larger flat surfaces 36 between any two adjacent conductors will create an electric field of a higher magnitude and, therefore, a higher coupling, than the field between facing pointed surfaces 38.

However, it should be noted that the surfaces 70 between conductors 60*a*, between conductors 60*b*, between conductors 62*a*, between conductors 64*a* and between conductors 64*b* in the two rows 66 and 68 are rounded in comparison to the larger flat opposing surfaces 72 between conductors 62*b* in the two rows. Therefore, larger flat surfaces 72 between adjacent conductors 62*b* in the two rows will create a higher electric field magnitude and, therefore, a higher capacitive coupling, than either the opposing or facing pointed surfaces 38 or the opposing, facing rounded surfaces 70 between any other two conductors in either row or in the adjacent conductors in both rows.

It should be understood that such terms as "left" and "right" have been used herein and in the claims hereof to facilitate a concise description and better understand of the invention. Such terms are not intended in any way to be limiting, because it is clearly understandable that the concepts of the invention are embodied in electrical circuit arrangements which are totally omni-directional in nature.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical circuit arrangement which includes at least three adjacent spaced-apart, elongate parallel conductors including a middle conductor having two oppositely facing first and second surfaces, a left conductor having a surface facing the first surface of the middle conductor to define a first electrical coupling, and a right conductor having a surface facing the second surface of the middle conductor to define a second electrical coupling, wherein the improvement comprises the shape of the facing surfaces between the left conductor and the middle conductor is different from the shape of the facing surfaces between the right conductor and the middle conductor, and the facing surfaces between one of the left and right conductors and the center conductor are narrower than the facing surfaces between the other of the left and right conductors and the middle conductor, whereby the electrical characteristics of the first electrical coupling is different from the electrical characteristics of the second electrical coupling.

2. In an electrical circuit arrangement as set forth in claim 1, wherein the facing surfaces between at least one of the left and right conductors and the middle conductor are pointed.

3. In an electrical circuit arrangement as set forth in claim 1, wherein the facing surfaces between at least one of the left and right conductors and the middle conductor are generally flat.

4. In an electrical circuit arrangement as set forth in claim 1, wherein the facing surfaces between at least one of the left and right conductors and the middle conductor are rounded.

5. In an electrical circuit arrangement as set forth in claim 1 wherein said conductors are embodied in an electrical cable with the conductors in a generally parallel array.

6. In an electrical circuit arrangement as set forth in claim 1 wherein said conductors comprise terminals in an electrical connector.

7. In an electrical circuit arrangement which includes at least three adjacent spaced-apart, elongate parallel conductors, comprising:

a first conductor having first and second surfaces facing in different directions, a second conductor having a surface facing the first surface of the first conductor to define a first electrical coupling, a third conductor having a surface facing the second surface of the first conductor to define a second electrical coupling, and the shape of the facing surfaces between the first and second conductors being different from the shape of the facing surfaces between the first and third conductors, and the facing surfaces between one of the second and third conductors and the first conductor are narrower than the facing surfaces between the other of the second and third conductors and the first conductor;

whereby the electrical characteristics of the first electrical coupling is different from the electrical characteristics of the second electrical characteristics of the second electrical coupling.

8. In an electrical circuit arrangement as set forth in claim 7, wherein said first, second and third conductors are in a single row of conductors.

9. In an electrical circuit arrangement as set forth in claim 7, wherein said first and second conductors are in a first row of conductors and said third conductor is in a second row of conductors.

10. In an electrical circuit arrangement as set forth in claim 7, wherein the facing surfaces between at least the second and third conductors and the first conductor are pointed.

11. In an electrical circuit arrangement as set forth in claim 7, wherein the facing surfaces between at least one of the second and third conductors and the first conductor are generally flat.

12. In an electrical circuit arrangement as set forth in claim 7, wherein the facing surfaces between at least one of the second and third conductors and the first conductor are rounded.

13. In an electrical circuit arrangement which includes at least three adjacent spaced-apart, elongate parallel conductors including a middle conductor having two oppositely facing first and second surfaces, a left conductor having a surface facing the first surface of the middle conductor to define a first electrical coupling, and a right conductor having a surface facing the second surface of the middle conductor to define a second electrical coupling, wherein the improvement comprises the conductors being equally spaced apart each having a cross sectional area which is generally equal to the other conductors, the shape of the facing surfaces between the left conductor and the middle conductor is different from the shape of the facing surfaces between the right conductor and the middle conductor, whereby the electrical characteristics of the first electrical coupling is different from the electrical characteristics of the second electrical coupling.

14. In an electrical circuit arrangement which includes at least three adjacent equally spaced-apart, elongate parallel conductors each having a cross sectional area generally equal to the other conductors, comprising:

a first conductor having first and second surfaces facing in different directions, a second conductor having a surface facing the first surface of the first conductor to define a first electrical coupling, a third conductor having a surface facing the second surface of the first conductor to define a second electrical coupling, and the shape of the facing surfaces between the first and second conductors being different from the shape of the facing surfaces between the first and third conductors, whereby the electrical characteristics of the first electrical coupling is different from the electrical characteristics of the second electrical characteristics of the second electrical coupling.

* * * * *